United States Patent [19]

Sumpter

[11] 4,289,341

[45] Sep. 15, 1981

[54] APPARATUS FOR SUPPORTING MACRAME DURING FORMATION OF A PARTICULAR ARTICLE

[76] Inventor: Floyd H. Sumpter, 1766 Trudean Way, San Jose, Calif. 95132

[21] Appl. No.: 117,503

[22] Filed: Feb. 1, 1980

[51] Int. Cl.[3] ..... D03J 3/00

[52] U.S. Cl. ..... 289/16.5; 248/124

[58] Field of Search ..... 289/16.5; 24/73 CH; 248/124

[56] References Cited

U.S. PATENT DOCUMENTS

| | | | |
|---|---|---|---|
| 254,288 | 2/1882 | Dimmick | 289/16.5 |
| 362,124 | 5/1887 | Thompson | 24/73 CH |
| 513,113 | 1/1894 | Kelly . | |
| 1,203,781 | 11/1916 | Ratycia | 289/16.5 |
| 2,320,003 | 5/1943 | Madan | 24/73 CH |
| 3,688,357 | 9/1972 | Nielsen et al. | 289/16.5 |
| 4,003,592 | 1/1977 | Schreues | 289/16.5 |
| 4,029,347 | 6/1977 | Garcia | 289/16.5 |
| 4,045,061 | 8/1977 | Fierro | 289/16.5 |
| 4,111,471 | 9/1978 | Hanley | 289/16.5 |
| 4,120,522 | 10/1978 | Rodnunsky | 289/16.5 |
| 4,124,237 | 11/1978 | Catania | 289/16.5 |
| 4,186,951 | 2/1980 | Stephenson | 289/16.5 |

FOREIGN PATENT DOCUMENTS

| | | | |
|---|---|---|---|
| 24522 | of 1904 | United Kingdom | 24/73 CH |

*Primary Examiner*—Louis Rimrodt

*Attorney, Agent, or Firm*—Flehr, Hohbach, Test

[57] ABSTRACT

An apparatus for supporting macrame during formation of a particular article is disclosed herein. The apparatus includes a number of cooperating components for supporting the macrame at a plurality of different points which are both horizontally and vertically adjustable to suit the individual forming the macrame article.

8 Claims, 4 Drawing Figures

APPARATUS FOR SUPPORTING MACRAME DURING FORMATION OF A PARTICULAR ARTICLE

The present invention relates generally to apparatus for supporting macrame during formation of a given article and more particularly to a specifically designed apparatus which is readily adjustable both horizontally and vertically to meet the needs of the individual using it.

One common method of making a macrame article is to suspend the macrame from a suitable support so that its formation into an article progresses in a vertically downward direction until its is completed. In the past, doorknobs, lamp fixtures, chair arms, tops of doors and the like have been used as supports for this purpose. More recently, different apparatus specifically designed for supporting macrame during formation of a particular article have been proposed in U.S. Pat. Nos. 4,003,592 (Schreves); 4,029,347 (Garcia); 4,111,471 (Hanley); and 4,120,522 (Rodnunsky). In each of these patents, the disclosed apparatus is capable of supporting its macrame article between different vertically adjusted positions. This is best exemplified in the Schreves patent which describes a macrame assembly holder including a single macrame engaging hook supported by a chain for vertical adjustment. In addition, in the Rodnunsky patent, an apparatus is disclosed which includes a vertical post supporting a pair of opposing horizontal brackets, each of which, in turn, supports a hook member between different horizontally adjustable positions.

One major drawback in the various macrame supporting apparatus disclosed in the recited patents including Rodnunsky is that they do not take into account the horizontal dimension of a given macrame article to be formed and the variable nature of this dimension from one article to another or the possible necessity to support different articles at different horizontally spaced points. As will be seen hereinafter, the macrame support apparatus disclosed herein is one which not only takes into account changes in the vertical dimension of a given macrame article during formation of the latter but also taken into account the variable nature of its horizontal dimension. Moreover, this is accomplished in an uncomplicated and easily manipulated way.

In view of the foregoing, one object of the present invention is to provide an apparatus for supporting macrame during formation of a particular article at a plurality of horizontally spaced points which are both vertically and horizontally adjustable in order to take into account the continual increase in the vertical dimension of the article as the latter is formed and variations in the horizontal dimension of different articles or the necessity to support different articles at different horizontally spaced points.

Another object of the present invention is to provide a macrame support apparatus capable of carrying out the last mentioned object in an uncomplicated and yet reliable way.

As will be described in more detail hereinafter, the apparatus disclosed herein for meeting the objectives just recited is one which utilizes means including an upwardly extending support post mounted for vertical movement between different adjustably fixed positions. A horizontally extending crossbar is connected with and extends on opposite sides of the support post for vertical movement therewith, whereby the crossbar is vertically adjustable along with the support post. The apparatus also includes first and second groups of hook means respectively connected with first and second sections of the crossbar on opposite sides of the support post for engaging the macrame and suspending the latter from the crossbar sections. In accordance with the present invention, each of the hook means in each group is individually movable horizontally along its connected crossbar section, whereby the points of suspension of a supported macrame can be adjusted horizontally relative to the crossbar.

The apparatus disclosed herein will be described in more detail hereinafter in conjunction with the drawings wherein.

Figure 1:
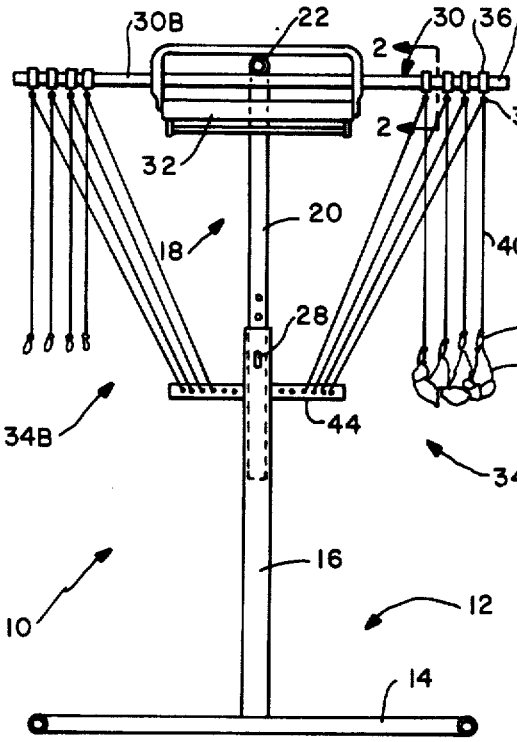
FIG. 1 is a front elevational view of an apparatus designed in accordance with the present invention for supporting macrame during formation of a particular macrame article.
Figure 1A:
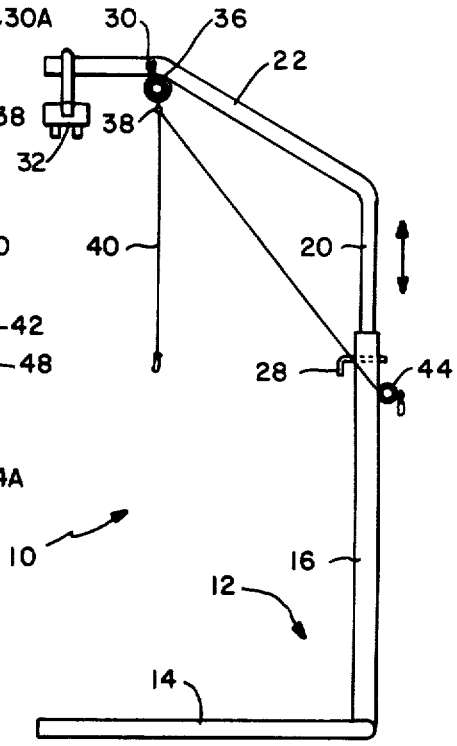
FIG. 1A is a side elevational view of the apparatus of FIG. 1.

Turning now to the drawing, wherein like components are designated by like reference numerals throughout the three figures, attention is first directed to FIG. 1 which illustrates an apparatus 10 designed in accordance with the present invention for supporting macrame during formation of a particular article. As seen in FIG. 1, apparatus 10 includes a base arrangement comprised of a U-shaped, horizontally extending base 14 adapted for positioning on the floor and a hollow post 16 fixably connected to and extending vertically upward from the base. In an actual working embodiment, base 14 is formed into its U-shape from a continuous tube and both the base and support post are circular in cross section. In this actual embodiment, post 16 is welded to tubular base 14 but may be connected in any other suitable way.

Figure 2:
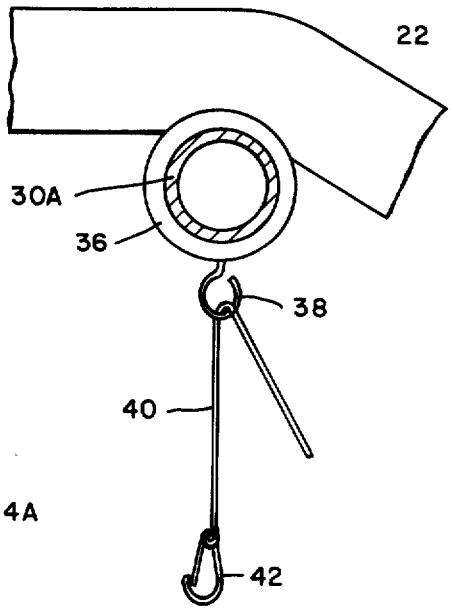
FIG. 2 is a side elevational view of a top section of the apparatus of FIG. 1.

Apparatus 10 also includes a movable support post 18 having a vertically extending bottom section 20 and a top section 22 at an angle with the horizontal, as best seen in FIG. 2. Post section 20 is concentrically supported within fixed post 16 for telescopic movement in the vertical direction between a lowermost position and an uppermost position. In this way, the entire post 18 is vertically movable between these extreme positions.

In order to adjustably fix post 18 in either its lowermost or uppermost positions and in any one of a number of vertically adjustable positions therebetween, section 20 of movable post 18 includes a plurality of spaced apart, vertically aligned openings 24 along a lower end portion and fixed post 16 includes a single through hole 26 near its top end. This through hole is positioned to confront any one of the openings 24 depending upon the vertical position of post 18. This latter post may be locked into place by means of a locking pin 28 which is disposed into through hole 26 and into a confronting opening 24.

In addition to the foregoing, apparatus 10 includes a horizontally extending cross-bar 30 welded or otherwise suitably connected with section 22 of support post 18 for vertical movement therewith. As best seen in FIG. 1, the cross-bar 30 includes sections **30*a* and 30*b*** on opposite sides of post 18. As best seen in FIG. 2, the cross-bar extends perpendicular to post section 22 and is located a short distance in front of section 20. In an actual working embodiment, a luminaire 32 is fixedly mounted to the top, otherwise free end of post section 22 and directed downward in front of the fixed post 16. A suitable cord (not shown) is, of course, provided for carrying power to the luminaire.

Figure 3:
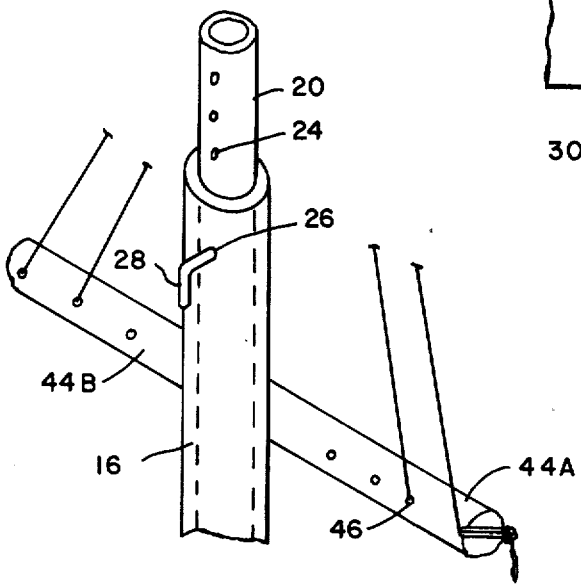
FIG. 3 is an enlarged perspective view, partially broken away, of a particular structural detail of the apparatus of FIG. 1.

In accordance with the present invention, apparatus 10 includes two groups of hook arrangements 34*a* and 34*b* respectively connected with sections 30*a* and 30*b* of cross-bar 30 for engaging the macrame at different horizontally spaced points and suspending the latter from the cross-bar sections. Each of the hook arrangements in each group includes a ring shaped slide element 36 mounted around and slidable along an associated one of the cross-bar sections for horizontal adjustment. As best seen in FIG. 4, each ring shaped element supports on its underside a depending eyebolt 38 provided for slidably receiving and supporting a length of cord 40, one end of which includes a snaphook 42. The snaphook serves to disengagably connect the attached cord with the macrame for supporting the latter at a given point. As seen best in FIG. 2, the other end of cord 40 is attached to an anchor bar 44 welded or otherwise suitably connected to post 16, preferrably in a direction normal to the latter such that the anchor bar is divided into two sections 44*a* and 44*b* on opposite sides of the post. The anchor bar includes a plurality of through holes 46, at least equal in number to the number of cords 40 provided. As best seen in FIG. 2 in conjunction with FIG. 3, starting from its associated hook 42, each cord extends up to and passes through an associated eye-bolt 38 and thereafter downwardly and rearwardly to anchor bar 44 and through an associated through hole 46. Each cord is knotted or provided with suitable clip means (not shown) behind the anchor bar in order to remain attached to the latter and support its associated snaphook in a fixed vertical position.

From the foregoing description of hook arrangements 34*a* and 34*b*, it should be apparent that a given hook associated with each arrangement is individually vertically adjustable by raising it or lowering it with respect to its associated slide element 36. In this regard, the total length of cord 40 must be sufficiently long to provide the maximum desired vertical adjustment of the hook between its uppermost position indicated by solid lines in FIG. 2 and its lowermost position indicated by dotted lines. As the hook is positioned above its lowermost position, any excess cord is retained behind the anchor bar, as illustrated. In addition to this individual vertical adjustment of each hook, it should be apparent that all of the hooks are horizontally adjustable merely by sliding their associated element 36 along the cross-bar section to which it is mounted. Of course, all of the hooks are vertically adjustable as a group by raising and lowering post 18 relative to post 16.

Having described apparatus 10, attention is now directed to the way in which it may be used in forming a given macrame article, for example, the one shown (only partially started) at 48 in FIG. 1. At the outset, the cross-bar 30 is vertically adjusted to a comfortable position for the operator (the individual forming the macrame article). At the same time, the hooks are individually vertically adjusted, usually to the same height. The actual number of hook arrangements and their spacing horizontally will depend on the horizontal dimension of the article and the spacing between adjacent strand formation. As seen in FIG. 1, the article being formed utilizes 4 hook arrangements, all positioned on one side of post 18 and all approximately equal spaced from one another. Once the operator selects the desired number of hooks and the spacing therebetween, this usually does not change, although it could. As formation of the article progresses, it does so in a downward direction and therefore post 18 and/or the hooks either individually or in groups are increasingly raised to higher positions in order to retain the comfortable position of the operator.

What is claimed is:

1. An apparatus for supporting macrame during formation of a particular article from the supported macrame, said apparatus comprising:

(a) means including an upwardly extending support post mounted for vertical movement between different adjustably fixed positions;

(b) a horizontally extending cross-bar connected with and extending on opposite sides of said support post for vertical movement therewith, whereby to adjust the height of said cross-bar from the floor; and (c) first and second groups of hook arrangements respectively connected with first and secod sections of said cross-bar on opposite sides of said support post and including associated hooks for engaging said macrame and suspending the latter from said cross-bar sections, each of said hook arrangements in each of said groups also including first means for individually moving its associated hook horizontally along its connected cross-bar section, whereby the points of suspension of a supported macrame can be adjusted horizontally relative to said cross-bar and second means independent of said first means for individually moving its associated hook vertically, whereby the points of suspension of a supported macrame can be adjusted vertically relative to said cross-bar, independent of their horizontal positions.

2. An apparatus according to claim 1 wherein each of said first means includes a slide member mounted with and movable along an associated one of said cross-bar sections and wherein said second means includes a cord connected with an associated hook at one end and slidably connected with said slide member for movement therewith, each of said cords supporting its hook for vertical movement between different adjustably fixed positions while, at the same time moving horizontally with its connected slide.

3. An apparatus according to claim 1 including a luminaire mounted with said support post for movement therewith and positioned adjacent and in front of said cross-bar so as to direct light downward and in front of a suspended macrame.

4. An apparatus according to claim 1 wherein said post including means also includes a base arrangement having a horizontally extending base for positioning on the floor and a fixed vertical post connected with said base for supporting said movable support post for vertical movement, and means for adjustably fixing the vertical position of said movable support post relative to said fixed post.

5. An apparatus for supporting macrame during formation of a particular macrame article from the supported macrame, said apparatus comprising:

(a) a base arrangement including a horizontally extending base for positioning on the floor and a hollow post fixedly connected to and extending vertically upwardly from said base;

(b) a movable support post extending up from and supported by said fixed post for vertical movement between a lowermost vertical position and an uppermost vertical position;

(c) means for adjustably fixing the position of said movable post at and between said lowermost and uppermost positions;

(d) a horizontally extending cross-bar connected with said movable support post for vertical movement therewith and including first and second sections on opposite sides of said movable post; and (e) first and second groups of hook arrangement respectively connected with said first and second cross-bar sections for engaging said macrame at different horizontally spaced points and suspending the latter from said cross-bar sections, each of said hook arrangements including (i) a slide member mounted with and slidably movable along an associated one of said cross-bar sections, (ii) a hook disengagably connectable to said macrame, and (iii) a support cord attached to said hook and slidably connected with said slide member for supporting said hook for vertical movement relative to said slide member and independent of its horizontal position on said cross-bar section, said cord being disengagably connectable with said base arrangement for maintaining said hook in an adjustably fixed vertical position relative to said slide member whereby said hook can be adjusted vertically and horizontally independent of one another.

6. An apparatus according to claim 5 including a horizontal anchor bar fixedly connected to said fixed post for disengagably retaining all of the cords of said hook arrangements.

7. An apparatus according to claim 5 wherein said upwardly extending movable support post includes a lower vertical section positioned telescopically within said fixed post and an upper section extending upwardly and forwardly from said lower section at an incline with the horizontal, said cross-bar being connected with said upper section in front of and above said lower section.

8. An apparatus according to claim 7 including a luminaire connected with and supported by said upper post section and directed downward.

* * * * *